US009410351B2

(12) United States Patent
Ebeling

(10) Patent No.: US 9,410,351 B2
(45) Date of Patent: Aug. 9, 2016

(54) SLIDE-GLIDE PRIVACY BLIND BARRIER SYSTEM

(71) Applicant: Cordell E Ebeling, Isanti, MN (US)

(72) Inventor: Cordell E Ebeling, Isanti, MN (US)

(73) Assignee: Cordell E. Ebeling, Isanti, MN (US)

( * ) Notice: Subject to any disclaimer, the term of this patent is extended or adjusted under 35 U.S.C. 154(b) by 0 days.

(21) Appl. No.: 14/211,017

(22) Filed: Mar. 14, 2014

(65) Prior Publication Data

US 2014/0338845 A1 Nov. 20, 2014

Related U.S. Application Data

(63) Continuation of application No. 61/783,519, filed on Mar. 14, 2013.

(51) Int. Cl.

| | |
|---|---|
| ***E05D 15/00*** | (2006.01) |
| ***E05D 15/06*** | (2006.01) |
| ***E04H 17/14*** | (2006.01) |
| ***E05F 17/00*** | (2006.01) |
| *E04F 11/18* | (2006.01) |

(52) U.S. Cl.

CPC ..... *E05D 15/0621* (2013.01); *E04F 11/1817* (2013.01); *E04F 11/1842* (2013.01); *E04H 17/1417* (2013.01); *E05F 17/00* (2013.01); *E04F 2011/1821* (2013.01); *E04F 2011/1827* (2013.01); *E04F 2011/1876* (2013.01); *E04H 2017/1452* (2013.01)

(58) Field of Classification Search

CPC ..... E06B 3/46; E06B 9/01; E06B 9/02; E06B 9/04; E04H 17/00; E04H 17/14; E04H 2017/1447; E04F 11/18; E04F 11/1836; E04F 11/1842; E05D 15/06; E05D 15/16

USPC ..... 160/214, 222, 216; 49/130

See application file for complete search history.

(56) References Cited

U.S. PATENT DOCUMENTS

| | | | | | |
|---|---|---|---|---|---|
| 2,250,059 | A | * | 7/1941 | Farney | 181/22 |
| 2,595,329 | A | * | 5/1952 | Brooks | 5/94 |
| 2,991,843 | A | * | 7/1961 | Bell, Jr. | 55/482 |
| 3,342,458 | A | * | 9/1967 | Simonton | 256/24 |
| 3,444,919 | A | * | 5/1969 | Karoll | 160/184 |
| 3,564,770 | A | * | 2/1971 | Korbelic | 49/38 |
| 3,775,906 | A | * | 12/1973 | Dougherty | E05F 15/635 49/358 |
| 3,785,475 | A | * | 1/1974 | Maynard | B23Q 7/03 198/345.3 |
| 4,033,073 | A | * | 7/1977 | Bogan | 49/38 |
| 4,465,262 | A | * | 8/1984 | Itri et al. | 256/24 |
| 4,688,618 | A | * | 8/1987 | Saicheck, Jr. | E06B 9/362 60/168.1 R |

(Continued)

*Primary Examiner* — Katherine Mitchell
*Assistant Examiner* — Johnnie A Shablack
(74) *Attorney, Agent, or Firm* — Merchant & Gould P.C.

(57) ABSTRACT

A convertible slide-glide panel privacy (or blind barrier section) system is provided for deck railings or fences. The system may consist of identical panel sections. A first panel section may consist of a stationary panel. Additional identical panel sections may be in an opposite facing orientation with respect to the first panel section and may be configured to slide in-between the most outer stationary structural supports (i.e., an upper railing, a lower railing and posts) of a deck railing or fence in order to either cover or open an existing space or gap between stationary balusters. The stationary panel may be attached directly under an upper railing and attached slide pieces. The sliding path of the additional panel sections may be linear or curvilinear. The sliding panel sections in the system may be constructed from a combination of or individually from composites, wood, metals, glass, lattice, PVC and transparent thermoplastics.

18 Claims, 15 Drawing Sheets

(56) References Cited

U.S. PATENT DOCUMENTS 4,893,551 A * 1/1990 Sharp ..... B08B 15/023 454/56
4,914,859 A * 4/1990 Gionet ..... B66B 13/143 49/25
5,016,390 A * 5/1991 Johnson ..... 49/38
5,076,545 A * 12/1991 Bodzin ..... 256/1
5,155,936 A * 10/1992 Johnson ..... 49/38
5,422,552 A * 6/1995 Parisi ..... E05F 15/643 318/16
5,570,543 A * 11/1996 Bishop ..... 49/465
5,782,039 A * 7/1998 Scherer et al. ..... 49/465
5,878,695 A * 3/1999 Gent ..... 119/503
6,076,592 A * 6/2000 Grutzner ..... A47H 5/0325 160/331
6,305,670 B1 * 10/2001 Ward et al. ..... 256/59
6,581,332 B1 * 6/2003 Kim ..... E05F 15/635 49/358
6,601,831 B2 * 8/2003 Erwin ..... 256/65.05
6,702,259 B2 * 3/2004 Pratt ..... 256/65.03
6,945,518 B1 * 9/2005 Chrysler ..... 256/25
7,032,891 B2 * 4/2006 Rowley et al. ..... 256/26
7,389,975 B2 * 6/2008 Rowley et al. ..... 256/24
7,568,449 B2 * 8/2009 Hirokawa et al. ..... 119/452
7,673,853 B2 * 3/2010 Ebeling ..... 256/59
7,832,052 B2 * 11/2010 Vrielink ..... A47H 5/0325 16/87.4 R
8,002,642 B2 * 8/2011 Guerzini et al. ..... 472/116
8,015,752 B2 * 9/2011 Fullerton ..... H01F 7/0242 335/285
8,141,517 B2 * 3/2012 Shimoda et al. ..... 119/473
8,261,500 B2 * 9/2012 Sprague ..... 52/243.1
8,572,894 B2 * 11/2013 Busch ..... H02K 41/02 49/358
2006/0076545 A1 * 4/2006 Reynders et al. ..... 256/59
2006/0202186 A1 * 9/2006 Rowley et al. ..... 256/67
2008/0163549 A1 * 7/2008 Kim ..... 49/129
2009/0071074 A1 * 3/2009 Yates ..... 49/55
2009/0134377 A1 * 5/2009 Petta et al. ..... 256/65.01
2009/0200531 A1 * 8/2009 Rowley et al. ..... 256/27
2009/0250176 A1 * 10/2009 Ryan et al. ..... 160/185
2010/0159817 A1 * 6/2010 Lindgren ..... 454/211
2010/0237308 A1 * 9/2010 Lo ..... 256/26
2011/0198549 A1 * 8/2011 Hirokawa et al. ..... 256/24
2012/0159853 A1 * 6/2012 Mickelson ..... E05D 15/565 49/349
2012/0174484 A1 * 7/2012 Toro ..... E06B 9/04 49/50
2012/0217460 A1 * 8/2012 Bugh ..... E06B 11/02 256/73
2012/0233922 A1 * 9/2012 Flannery et al. ..... 49/55
2012/0235101 A1 * 9/2012 Flannery et al. ..... 256/24
2012/0319067 A1 * 12/2012 Millar ..... 256/19
2014/0007506 A1 * 1/2014 Huang ..... 49/149
2014/0124722 A1 * 5/2014 Mann ..... 256/21
2014/0190641 A1 * 7/2014 Wang ..... 160/222
2014/0338845 A1 * 11/2014 Ebeling ..... 160/214
2015/0047860 A1 * 2/2015 Rutherford ..... 169/48
2015/0082721 A1 * 3/2015 Francescon ..... 52/302.1
2015/0089873 A1 * 4/2015 Marsden et al. ..... 49/56
2015/0247341 A1 * 9/2015 Bizzarri ..... E04F 11/181 256/65.02

* cited by examiner

SLIDE-GLIDE PRIVACY BLIND BARRIER SYSTEM

CROSS-REFERENCE TO RELATED APPLICATION(S)

This application claims priority to U.S. Ser. No. 61/783,519, filed on Mar. 14, 2013, titled SLIDE-GLIDE PRIVACY BLIND BARRIER SYSTEM, the disclosure of which is hereby incorporated by reference in its entirety.

BACKGROUND

The home improvement industry has seen significant growth in the last decade and is projected to continue to grow in the future. For example, in a Jan. 14, 2011 report from Harvard University on the home improvement industry it is estimated that in 2005 alone, consumers spent over a quarter of a trillion dollars on home improvement projects, and that this number has been growing at a rate of about 7% per year. As a result, manufacturers and retailers spend significant effort in trying to differentiate their products from the competition.

One commonly undertaken home improvement project involves adding fences, railings, outdoor-rooms and similar barrier structures (e.g., outdoor kitchens) to homes and landscaping. Railings and fences are often added for aesthetic and practical reasons, such as to add interest to landscaping or to provide a privacy barrier and block weather elements, such as wind. In other applications, railings and fences may be practical or mandatory. For example, a raised deck (i.e., above two feet off of the ground) will require railings to comply with higher standard building safety codes. Some codes require at least 200 lb lateral load. Composite decking is commonly used as deck flowing or railings, but is not rigid enough to meet the code requirement if the railings has a longer height.

Standard deck railings and fences are typically constructed using a series of posts anchored to the ground as structural supports, decking or flooring structures and the outer walls of permanent building structures (also used as structural supports). The posts are connected via generally rectangular planar sections that provide a containment function, such as preventing the passage of people or animals, and "view blockage" from different perspectives. In many fencing and railing systems, these sections are formed by top and bottom vertical railings that are tied together by a plurality of vertical members (sometimes referred to as balusters) which form open sections in a deck railing or fence barrier. In other arrangements, the top and bottom railings are tied together (or integral with) a solid sheet of material, such as mesh, glass, metal, wood, composites, or lattice configurations. Sections that form a permanent containment barrier structure are only offered in two standard modes, open and solid sections. In modes offering open sections, there is a multitude of secondary add-on privacy screening available. In addition, there are advantages and disadvantages associated with solid fencing/railing sections and open sections that use balusters. For example, the solid sections can block wind and prevent the passage of very small items and can offer privacy from neighbors or onlookers looking in from an outside perspective of the containment barrier structure. However, blocking the view of what is on the outer side or the inner side of a barrier fence or railing can sometimes be a disadvantage. An open section provides a view through the railing, with the resulting loss of privacy. Oftentimes, a user may desire the privacy of a solid section during some conditions and also, under other conditions, desire the outward-looking view provided by open sections. Thus, there is a need for a fence or railing that selectably offers consumers the convenience of combining both open and solid closed barrier sections and that offers the advantages of personal preferences to convert between these structure sections depending on current use conditions and that will also meet various safety code standards (e.g., International Code Council (ICC), American Fence Association, and U.S. Department of Labor and Industry Construction Codes and Licensing Division standards) such as providing 200 pounds of lateral pressure. It is with respect to these considerations and others that the various embodiments of the present invention have been made.

SUMMARY

This summary is provided to introduce a selection of concepts in a simplified form that are further described below in the Detailed Description. This summary is not intended to identify key features or essential features of the claimed subject matter, nor is it intended as an aid in determining the scope of the claimed subject matter.

Embodiments provide a convertible slide-glide panel privacy system (or blind barrier section system, hereinafter "the system") for deck railings or fences. The system may consist of two or more identical panel sections. A first panel section may consist of a stationary panel. A second (or more) of the identical panel sections may be in an opposite facing orientation with respect to the first panel section and may be configured to slide in between the most outer stationary structural supports (i.e., an upper railing, a lower railing and posts) of a deck railing or fence in order to either cover or open an existing space or gap between stationary balusters. The stationary panel may be attached directly under the top railing and attached slide pieces. The sliding path of the second (or more) panel sections may be either linear or curvilinear. The sliding panel sections in the system may be constructed from a combination of or individually from the following materials: composites, wood, metals, glass, lattice, PVC and transparent thermoplastics such as Polymethyl methacrylate ("PMMA"), also known as PLEXIGLASS. The system may be either manually or automatically operated. These and other features and advantages will be apparent from a reading of the following detailed description and a review of the associated drawings. It is to be understood that both the foregoing general description and the following detailed description are illustrative only and are not restrictive of the invention as claimed.

Another aspect is a slide-glide panel privacy system for deck railings and fences comprising: a first stationary panel section comprising a first plurality of balusters; one or more sliding panel sections positioned in an opposite facing orientation with respect to the first panel section, the one or more sliding panel sections comprising a second plurality of balusters; an upper railing attached to the first and the one or more sliding panel sections; a lower railing attached to the first and the one or more sliding panel sections; at least one post attached to the upper and lower railings; and a plurality of slide pieces integrally attached to the second plurality of balusters, the plurality of slide pieces facilitating the movement of the one or more sliding panel sections along a sliding path such that the one or more sliding panel sections cover or open an existing space between the first plurality of balusters.

A further aspect is a blind barrier section system for a deck railing comprising: a first stationary panel section comprising a first plurality of balusters; a plurality of sliding panel sections positioned in an opposite facing orientation with respect to the first panel section, each of the plurality of sliding panel sections comprising a second plurality of balusters; an upper railing attached to the first and the plurality of sliding panel sections; a lower railing attached to the first and the plurality of sliding panel sections; a plurality of posts attached to the upper and lower railings; and a plurality of slide pieces integrally attached to the second plurality of balusters, the plurality of slide pieces facilitating the movement of the plurality of sliding panel sections along a sliding path such that the plurality of sliding panel sections cover or open existing gaps between the first plurality of balusters.

DETAILED DESCRIPTION

Embodiments provide a convertible slide-glide panel privacy system (or blind barrier section system, hereinafter "the system") for deck railings or fences. The system may consist of two or more identical panel sections. A first panel section may consist of a stationary panel. A second (or more) of the identical panel sections may be in an opposite facing orientation with respect to the first panel section and may be configured to slide in between the most outer stationary structural supports (i.e., an upper railing, a lower railing and posts) of a deck railing or fence in order to either cover or open an existing space or gap between stationary balusters. The stationary panel may be attached directly under the top railing and attached slide pieces. The sliding path of the second (or more) panel sections may be either linear or curvilinear. The sliding panel sections in the system may be constructed from a combination of or individually from the following materials: composites, wood, metals, glass, lattice, PVC and transparent thermoplastics such as Polymethyl methacrylate ("PMMA"), also known as PLEXIGLASS. The system may be either manually or automatically operated.

In the following detailed description, references are made to the accompanying drawings that form a part hereof, and in which are shown by way of illustrations specific embodiments or examples. These embodiments may be combined, other embodiments may be utilized, and structural changes may be made without departing from the spirit or scope of the present invention. The following detailed description is therefore not to be taken in a limiting sense, and the scope of the present invention is defined by the appended claims and their equivalents.

Figure 1A:
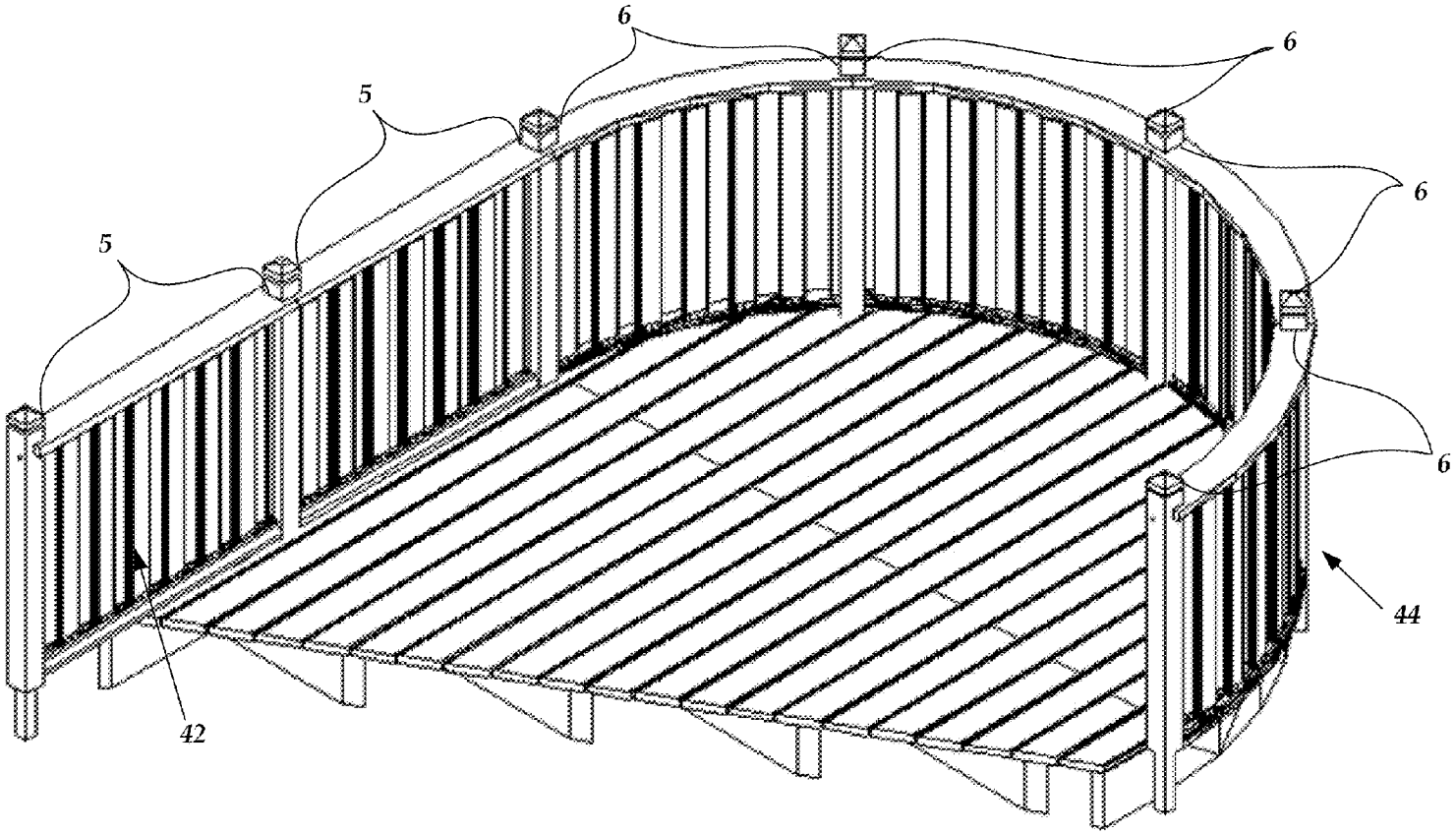
FIG. 1A is a perspective view of a deck incorporating a slide-glide panel privacy system, in accordance with an embodiment.

Referring now to the drawings, in which like numerals represent like elements through the several figures, various aspects of the present invention will be described. FIG. 1A is a perspective view is a perspective view of a deck incorporating a slide-glide panel privacy system, in accordance with an embodiment. The deck includes separate straight slide-glide panel sections (or barrier panels) 5 and curvilinear slide-glide panel sections (or barrier panels) 6. It should be understood that each of the individual panel sections 5 and 6 may operate independently or in concert with each other and may further be operated either manually or with automation (i.e., automatically).

Figure 1B:
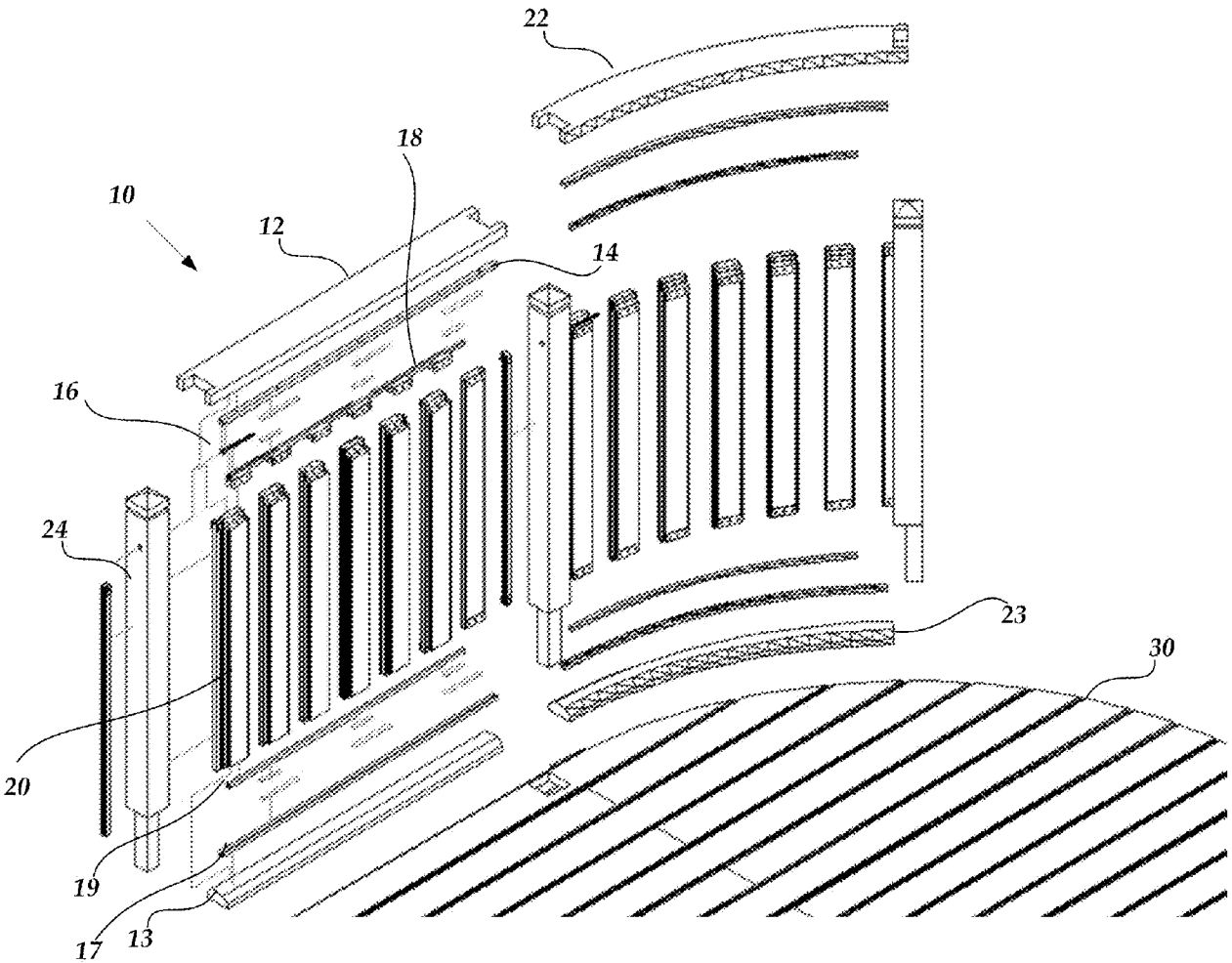
FIG. 1B is a partially exploded view of a deck railing incorporating a slide-glide panel privacy system, in accordance with an embodiment.

FIG. 1B is a partially exploded view of a deck railing 10 and a deck 30 incorporating the system, in accordance with an embodiment. The deck railing 10 may be comprised of one or more posts 24, straight top rail 12, curvilinear top rail 22, straight bottom rail 13, curvilinear bottom rail 23 and multiple sets of opposing balusters 20 and 28 which integrally utilize upper and lower slide-glides. As should be understood by those skilled in the art, the balusters 20 and 28 may comprise vertical members which tie together the top and bottom rails 12, 13, 22 and 23 and which form open sections in the deck railing 10. It should be understood however, that in accordance with alternative embodiments, the deck railing 10 may be tied together with a solid material such as mesh, glass, metal, wood, composites, etc. It should further be understood that, in accordance with various embodiments, the deck railing 10 may comprise one or more sections which may include one or more straight sections, one or more curvilinear barrier sections or a combination of both straight and curvilinear sections.

The system may comprise an upper channel 14, a control screw 16, the balusters 28 (which utilize integral slide-glides), a lower channel 18, an upper bottom channel 19 and a lower bottom channel 17, which are integrally positioned directly above and below the balusters 20. As will be described in greater detail below, the system may be utilized to cover existing spaces or gaps between stationary balusters comprising a deck railing in order to provide privacy as desired and as defined by a user's discretion.

Figure 2A:
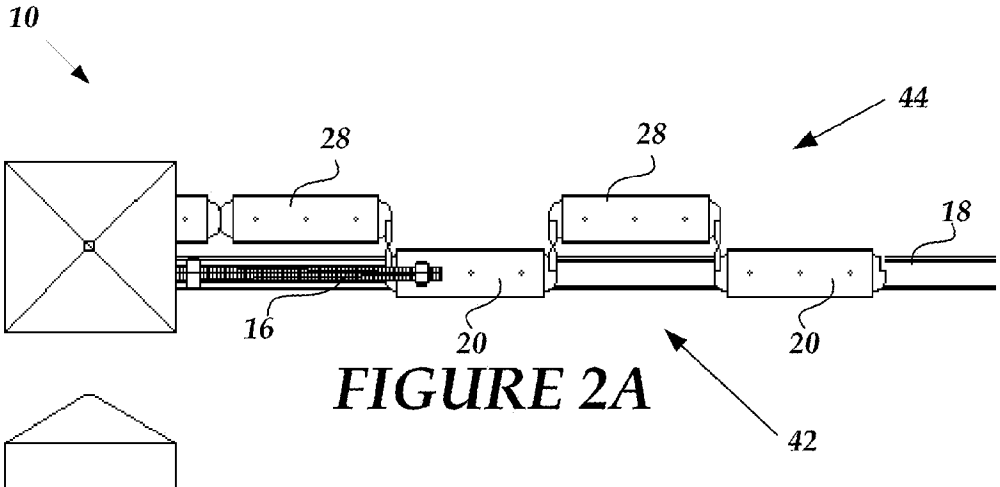
FIG. 2A is a top view of a slide-glide panel privacy system in a closed orientation, in accordance with an embodiment.

FIG. 2A is a top view of the system in a closed orientation, in the deck railing 10, in accordance with an embodiment. As shown in FIG. 2A, the balusters 20 in the deck railing 10 have been moved from their previous positions opposite the stationary balusters 28 to close the gaps or spaces between the balusters. As will be described in greater detail herein, the control screw 16 may be actuated (by either manual or automated means) to slide the balusters 20 in the lower channel 18 until they are seated in the gaps or spaces between the stationary balusters 28. In particular, the control screw 16 may be rotated in a first direction (i.e., a counter-clockwise direction) to push the balusters 20 from their initial position opposing the stationary balusters 28 to their final position over the gaps or spaces in the deck railing 10.

It should be understood that the system described in the aforementioned embodiment may utilize a number of different means of sliding movement and also utilize various track system configurations. In accordance with an embodiment, the system may utilize a combination of wheels, bearings, hangers (such as those used in garage door systems in which the door hangs on a shaft having wheels) and pin-shafts which travel on and in-between the upper and lower channels 14 and 18. In accordance with another embodiment, the system may utilize a combination of opposing magnets which travel on and in-between the upper and lower channels 14 and 18. It should be appreciated that the use of the opposing magnets facilitates a frictionless or nearly frictionless slide movement of the system from an open state or multiple user-defined semi-closed configurations. Other combinations may also be utilized.

Figure 2B:
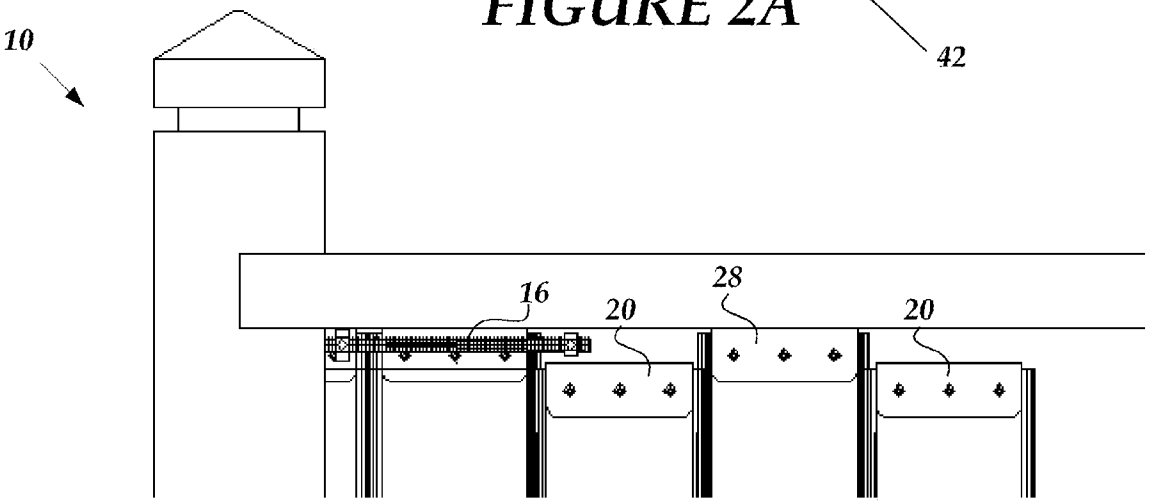
FIG. 2B is a front view of a slide-glide panel privacy system in a closed orientation, in accordance with an embodiment.

FIG. 2B is a front view of the system in a closed orientation, in the deck railing 10, in accordance with an embodiment. As shown in FIG. 2B, the balusters 20 in the deck railing 10 have been moved, via the rotation of the control screw 16, from their previous positions opposite the stationary balusters 28 to close the gaps or spaces between the balusters. It should be understood that the balusters 20 may be shorter than the stationary balusters 28 to facilitate the sliding of the balusters 20 in the upper channel 14.

Figure 3A:
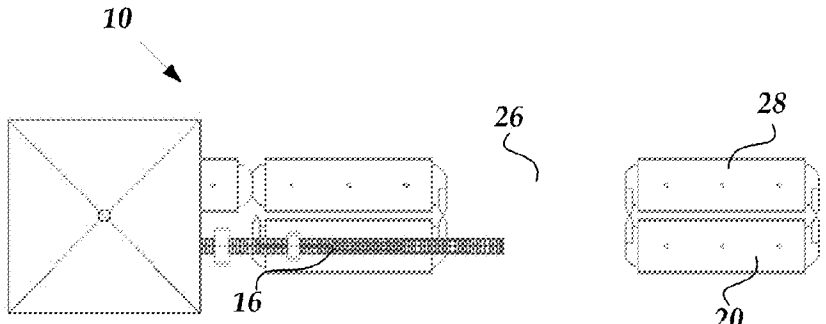
FIG. 3A is a top view of a slide-glide panel privacy system in an open orientation, in accordance with an embodiment.

FIG. 3A is a top view of the system in an open orientation, in the deck railing 10, in accordance with an embodiment. As shown in FIG. 3A, the balusters 20 in the deck railing 10 are oriented opposite the stationary balusters 28 thereby forming gaps or spaces between the balusters in the deck railing 10. As will be described in greater detail herein, the control screw 16 may be actuated (by either manual or automated means) to slide the balusters 20 in the lower channel 18 until they are oriented opposite the stationary balusters 28. In particular, the control screw 16 may be rotated in a second direction (i.e., a clockwise direction) to pull the balusters 20 from a closed orientation, in which the balusters 20 fill the gaps or spaces in the deck railing 10, to an open orientation opposite the stationary balusters 28.

Figure 3B:
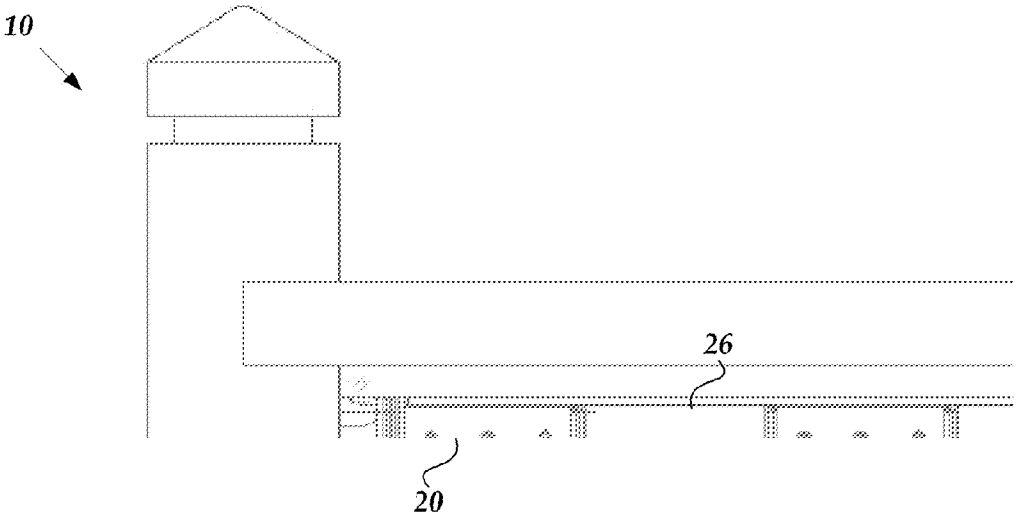
FIG. 3B is a front view of a slide-glide panel privacy system in an open orientation, in accordance with an embodiment.

FIG. 3B is a front view of the system in a closed orientation, in the deck railing 10, in accordance with an embodiment. As shown in FIG. 3B, the balusters 20 in the deck railing 10 are oriented opposite the stationary balusters 28, thereby forming gaps or spaces between the balusters in the deck railing 10.

Figure 4A:
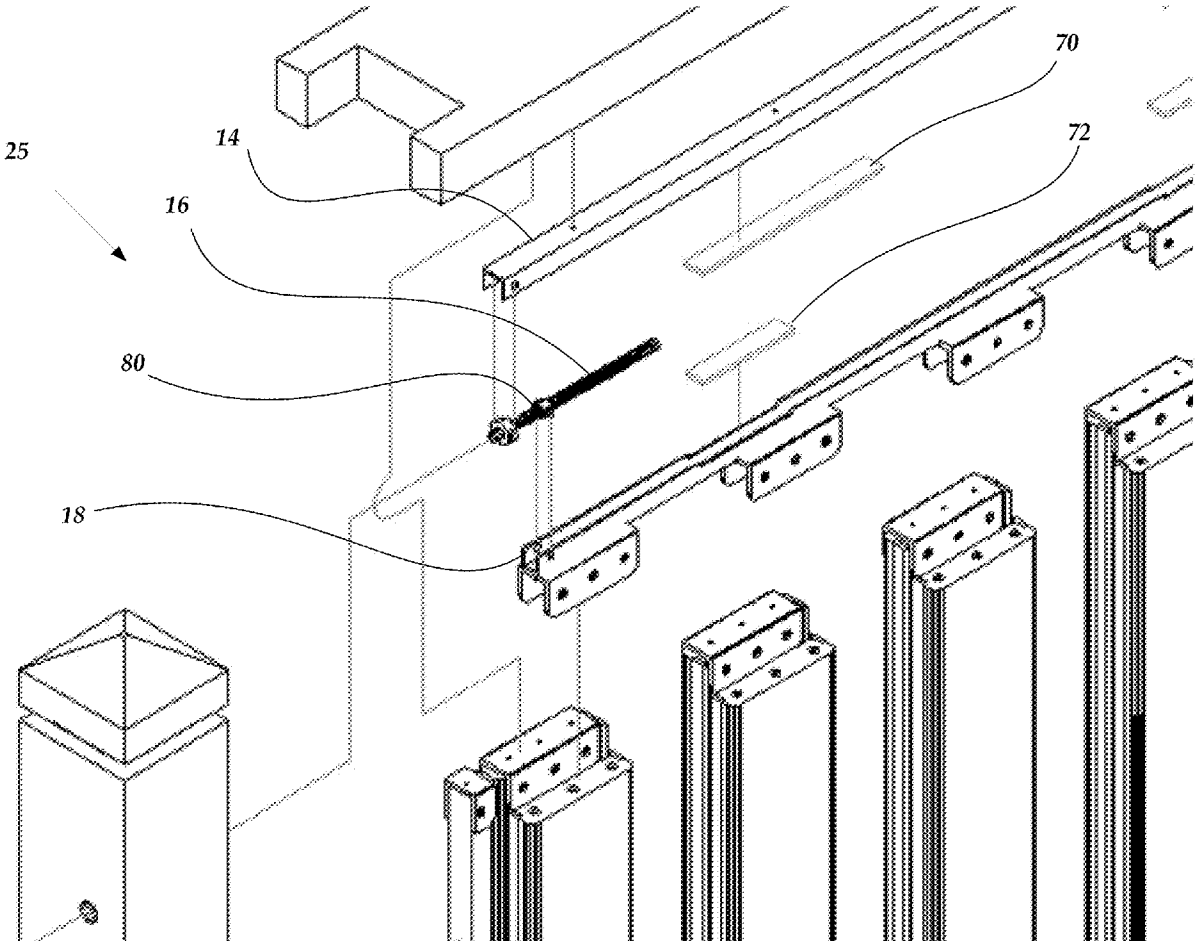
FIG. 4A is an exploded view of illustrative components utilized in a mode of operation of the slide-glide panel privacy system, in accordance with an embodiment.

FIG. 4A is an exploded view of illustrative components utilized in a mode of operation of the system, in accordance with an embodiment. In FIG. 4A, the components of a system 25 may include the upper channel 14, the control screw 16 and the lower channel 18. The control screw 16 may comprise an engaging nut 80 which may be utilized to engage openings in the lower channel 18 for pushing or pulling (depending on the direction of rotation of the control screw 16) balusters or panels of a deck railing barrier section. The system of FIG. 4A also includes two opposing magnets 70 and 72. As discussed above, the opposing magnets may be utilized for travel on and in-between the upper and lower channels 14 and 18. It should be appreciated that the use of the opposing magnets facilitates a frictionless or nearly frictionless slide movement of the system from an open state or multiple user-defined semi-closed configurations.

Figure 4B:
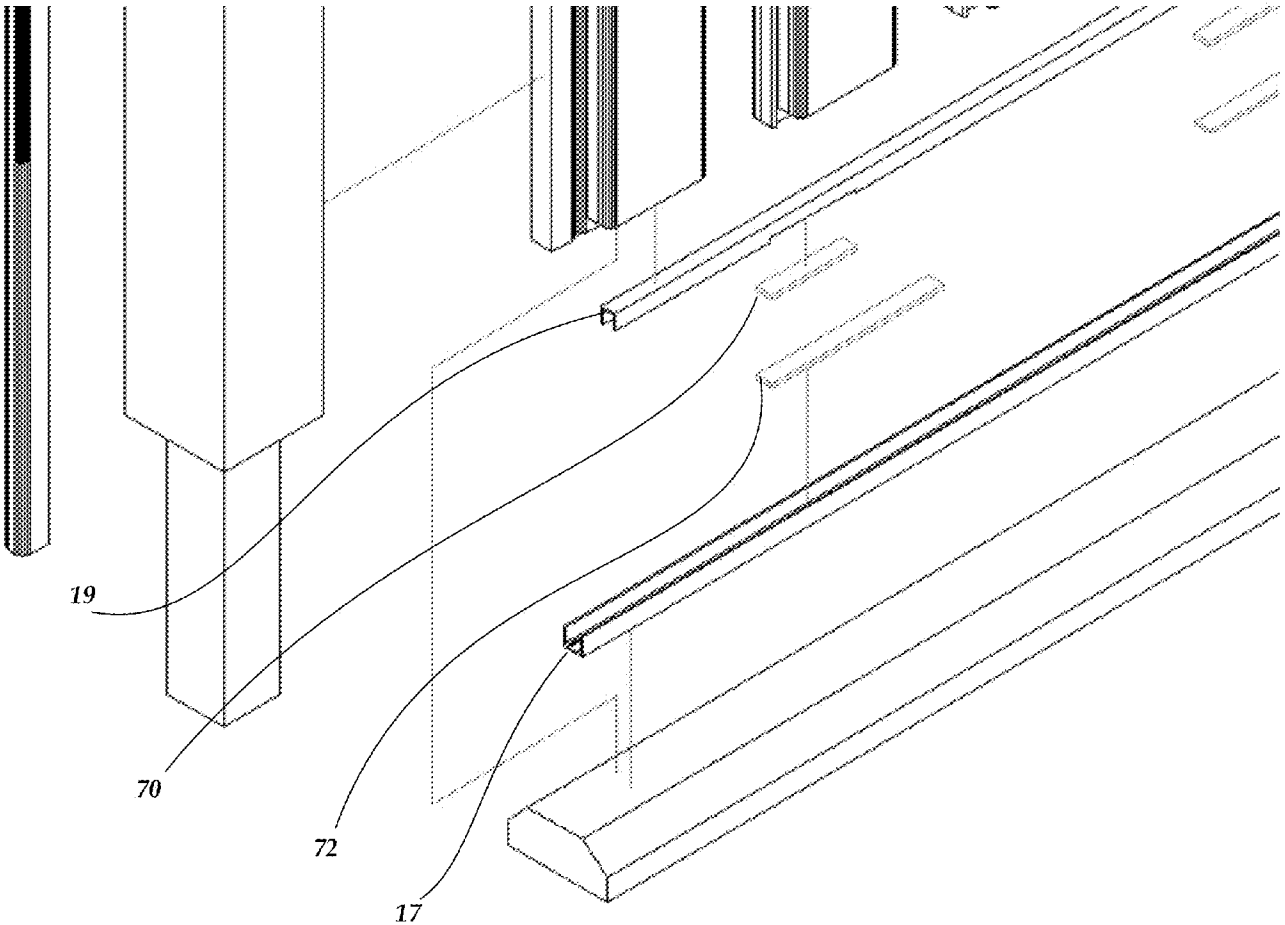
FIG. 4B is an exploded view of a bottom magnet configuration for the system of FIG. 4A, in accordance with an embodiment.

FIG. 4B is an exploded view of a bottom magnet configuration for the system of FIG. 4A, in accordance with an embodiment. As shown in FIG. 4B, the opposing magnets 70 and 72 may be positioned between the upper and lower bottom channels 19 and 17. As discussed above, the opposing magnets may be utilized for travel on and in-between the upper and lower bottom channels 19 and 17. It should be appreciated that the use of the opposing magnets facilitates a frictionless or nearly frictionless slide movement of the system from an open state or multiple user-defined semi-closed configurations.

Figure 5:
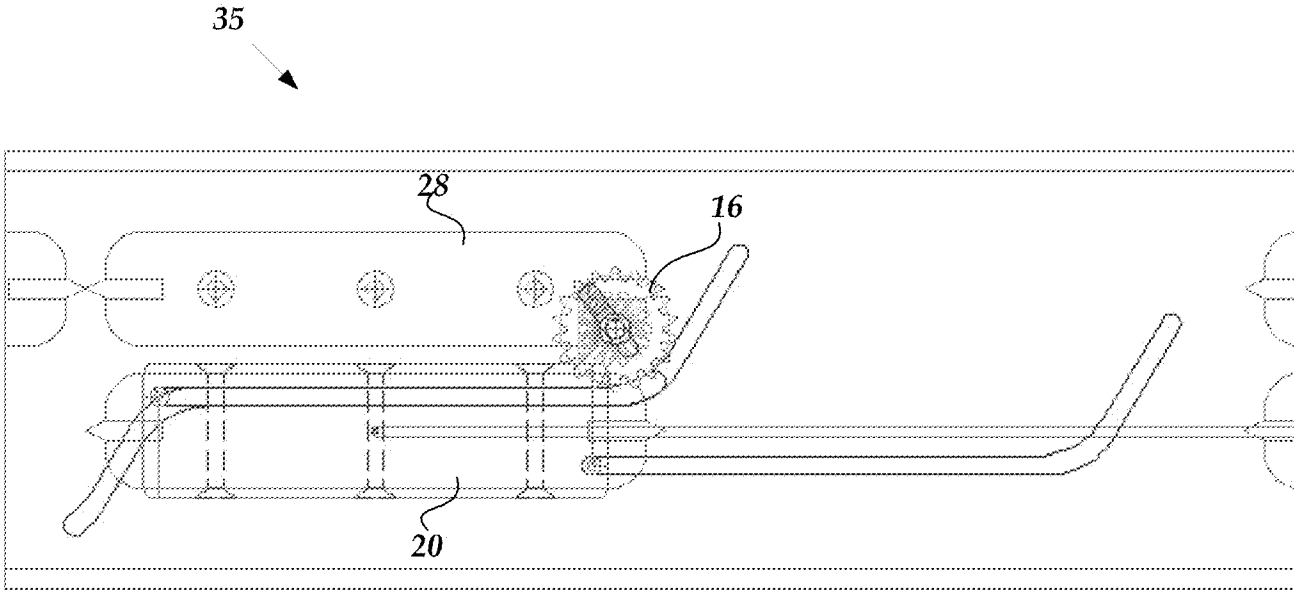
FIG. 5 is a top view of a slide-glide panel privacy system in an open orientation, in accordance with an alternative embodiment.

FIG. 5 is a top view of the system in an open orientation, in accordance with an alternative embodiment. In FIG. 5, a system 35 is shown in which a rotating gear mechanism 16 may be utilized (instead of the control screw 16) for sliding the balusters 20 against the stationary balusters 28 to open spaces or gaps in a deck railing.

Figure 6:
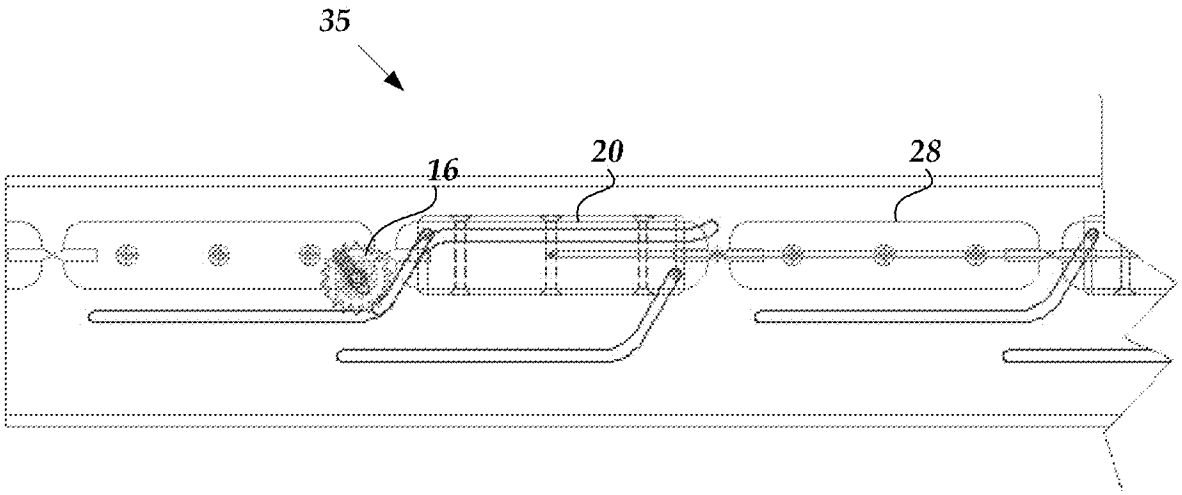
FIG. 6 is a top view of a slide-glide panel privacy blind system in a closed orientation, in accordance with an alternative embodiment.

FIG. 6 is a top view of the system in a closed orientation, in accordance with an alternative embodiment. In FIG. 6, the system 35 is shown in which the rotating gear mechanism 16 may be utilized (instead of the control screw 16) for sliding the balusters 20 against the stationary balusters 28 to close spaces or gaps in a deck railing.

Figure 7A:
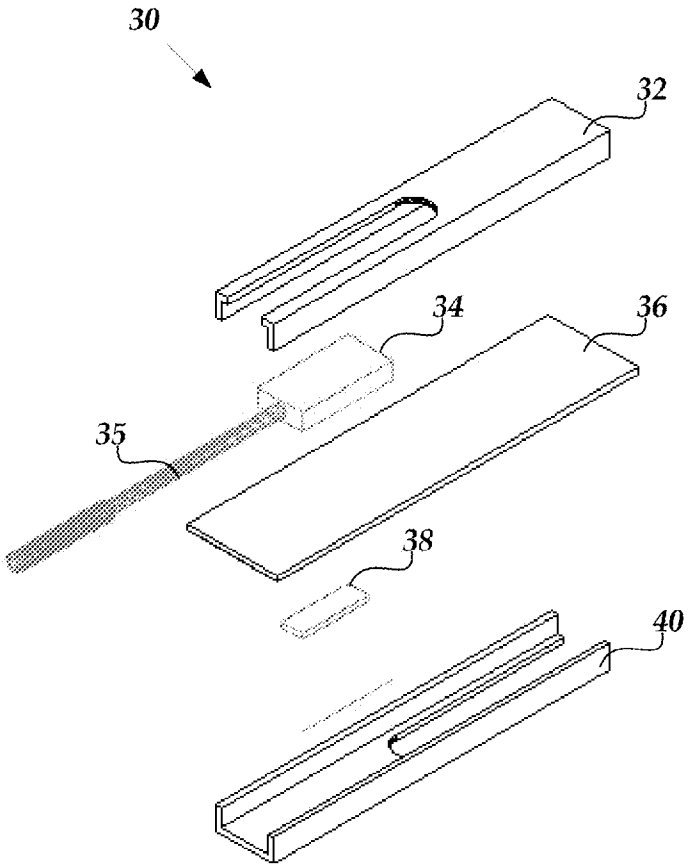
FIG. 7A is an exploded view of a bar safety slip mechanism which may be utilized in a slide-glide panel privacy system, in accordance with an embodiment.

FIG. 7A is an exploded view of a bar safety slip mechanism 30 which may be utilized in the system, in accordance with an embodiment. The bar safety slip mechanism 30 may include an upper non-magnetic housing 32, a first magnet 34, a shaft 35, a second magnet 38 and a lower non-magnetic housing 40. In accordance with an embodiment, the first and second magnets 34 and 38 have opposing polarities (i.e., one positive, one negative). It should be understood that the bar safety slip mechanism 30 may function as a magnetic decoupler in which the opposing magnets 34 and 38 attract each other inside of the upper and lower non-magnetic housings 32 and 40. The shaft 35 may be utilized to fasten to sections (e.g., balusters) of a deck railing or fence as well as to a manual or automated power source for opening and closing the aforementioned sections. In accordance with an alternative embodiment, one of the non-magnetic housings 32 or 40 may be molded into the balusters of a deck railing. It should be appreciated that the bar safety slip mechanism 30 may be utilized to decouple opening or closing of the balusters of a deck railing (such as when a person inadvertently slips their extremities (e.g., fingers) between the balusters) such that the movement of the balusters would stop thereby avoiding the pinching of the person's extremities between the balusters.

Figure 7B:
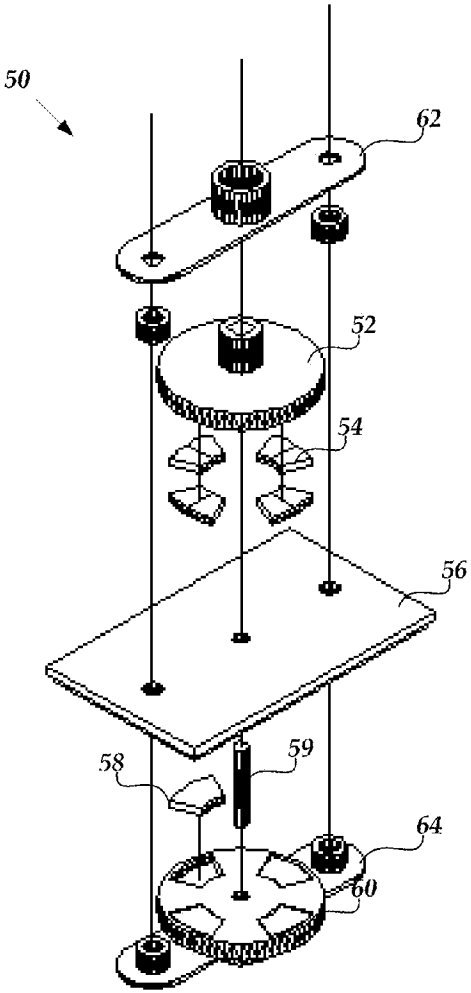
FIG. 7B is an exploded view of a cylindrical safety slip mechanism which may be utilized in a slide-glide panel privacy system, in accordance with an embodiment.

FIG. 7B is an exploded view of a cylindrical safety slip mechanism 50 which may be utilized in the system, in accordance with an embodiment. The cylindrical safety slip mechanism 50 may include an upper non-magnetic housing 52, a first set of magnets 54, a non-magnetic separator 56, a second set of magnets 58, a shaft 59, a lower magnetic housing 60, and upper and lower fastening members 62 and 64. In accordance with an embodiment, the first and second sets of magnets 54 and 58 have opposing polarities (i.e., positive and negative). It should be understood that the cylindrical safety slip mechanism 50 may function as a magnetic decoupler in which the opposing magnet sets 54 and 58 attract each other inside of the upper and lower non-magnetic housings 52 and 60. It should be appreciated that the cylindrical safety slip mechanism 50 may be utilized to decouple opening or closing of the balusters of a deck railing (such as when a person inadvertently slips their extremities between the balusters) such that the movement of the balusters would stop thereby avoiding the pinching of the person's extremities between the balusters.

Figure 7C:
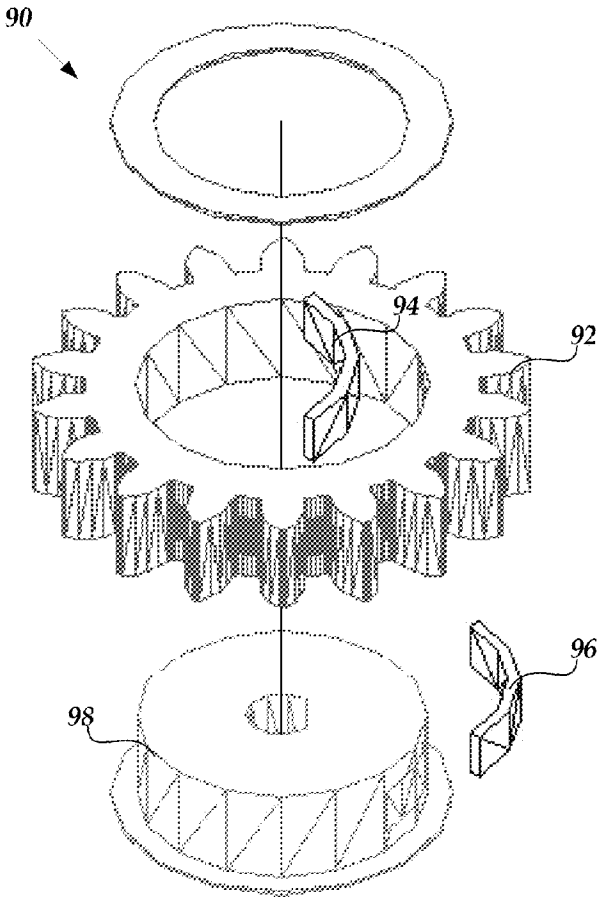
FIG. 7C is an exploded view of a cylindrical safety slip mechanism which may be utilized in a slide-glide panel privacy system, in accordance with another embodiment.

FIG. 7C is an exploded view of a cylindrical safety slip mechanism 90 which may be utilized in the system, in accordance with another embodiment. The cylindrical safety slip mechanism 90 may include an upper housing 92, a lower housing 98, and opposing magnets 94 and 96. In accordance with an embodiment, the magnets 94 and 96 have opposing polarities (i.e., positive and negative). It should be understood that the cylindrical safety slip mechanism 90 may function as a magnetic decoupler in which the opposing magnets 94 and 96 attract each other inside of the upper and lower housings 92 and 98. It should be appreciated that the cylindrical safety slip mechanism 90 may be utilized to decouple opening or closing of the balusters of a deck railing (such as when a person inadvertently slips their extremities between the balusters) such that the movement of the balusters would stop thereby avoiding the pinching of the person's extremities between the balusters.

Figure 8:
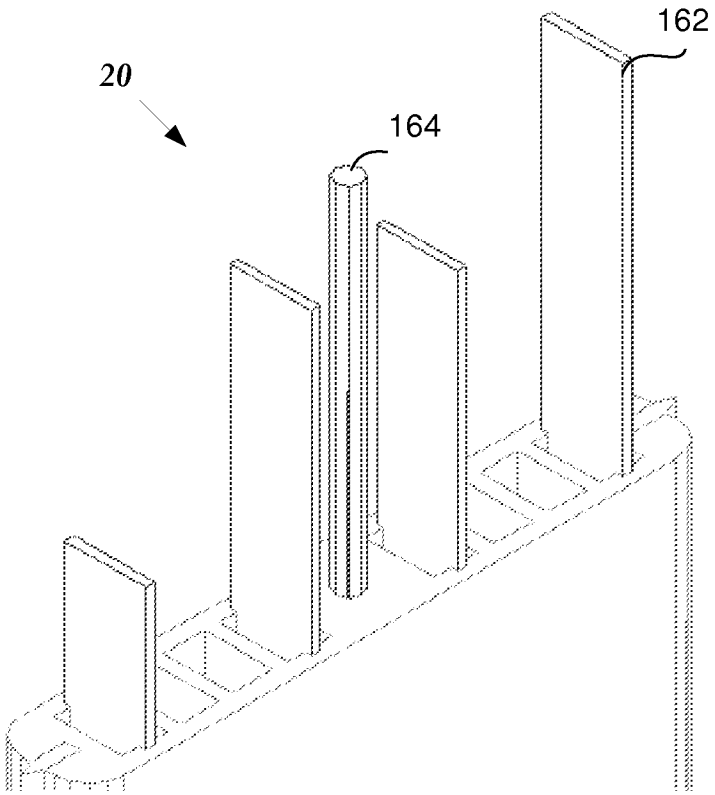
FIG. 8 is a perspective view of lateral reinforced inserts for balusters utilized in a slide-glide panel privacy system, in accordance with an embodiment.

FIG. 8 is a perspective view of lateral reinforced inserts 162 and 164 for balusters (e.g., a baluster 20) utilized in the system, in accordance with an embodiment. In particular, a baluster 20 may be manufactured out of composite, polyvinyl chloride ("PVC") or an extruded-type of material with hollowed-out sections or voids for receiving the lateral reinforced inserts 162 and 164. It should be understood that the lateral reinforced inserts 162 and 164 may be constructed of a metal material and may be utilized in composite and PVC balusters as well as balusters made of an extruded-type material because balusters constructed of the aforementioned materials are typically laterally weaker than alternative baluster construction materials such as wood or metal.

Figure 9:
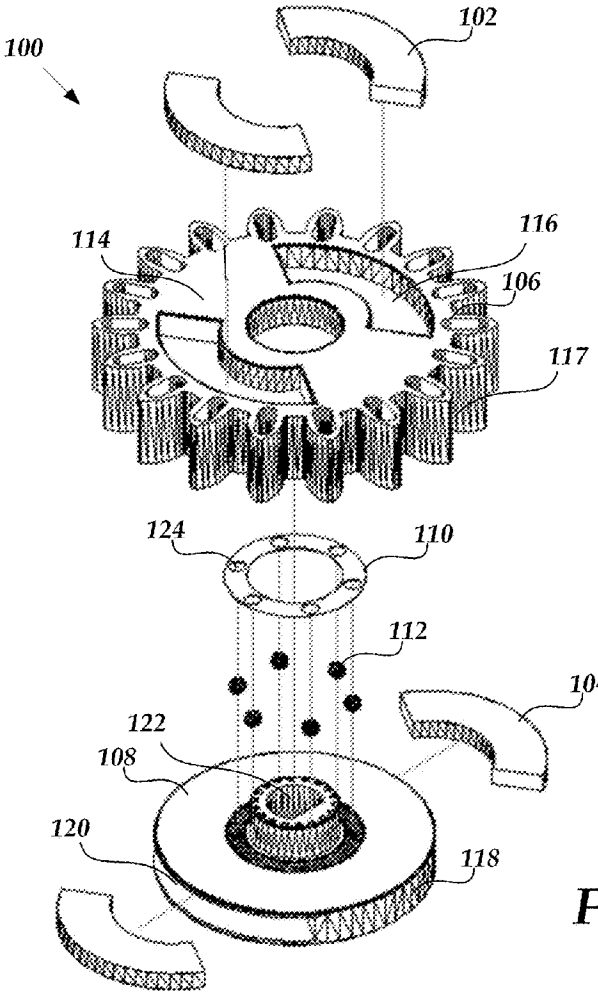
FIG. 9 is an exploded view of a further example cylindrical safety slip mechanism.
Figure 10:
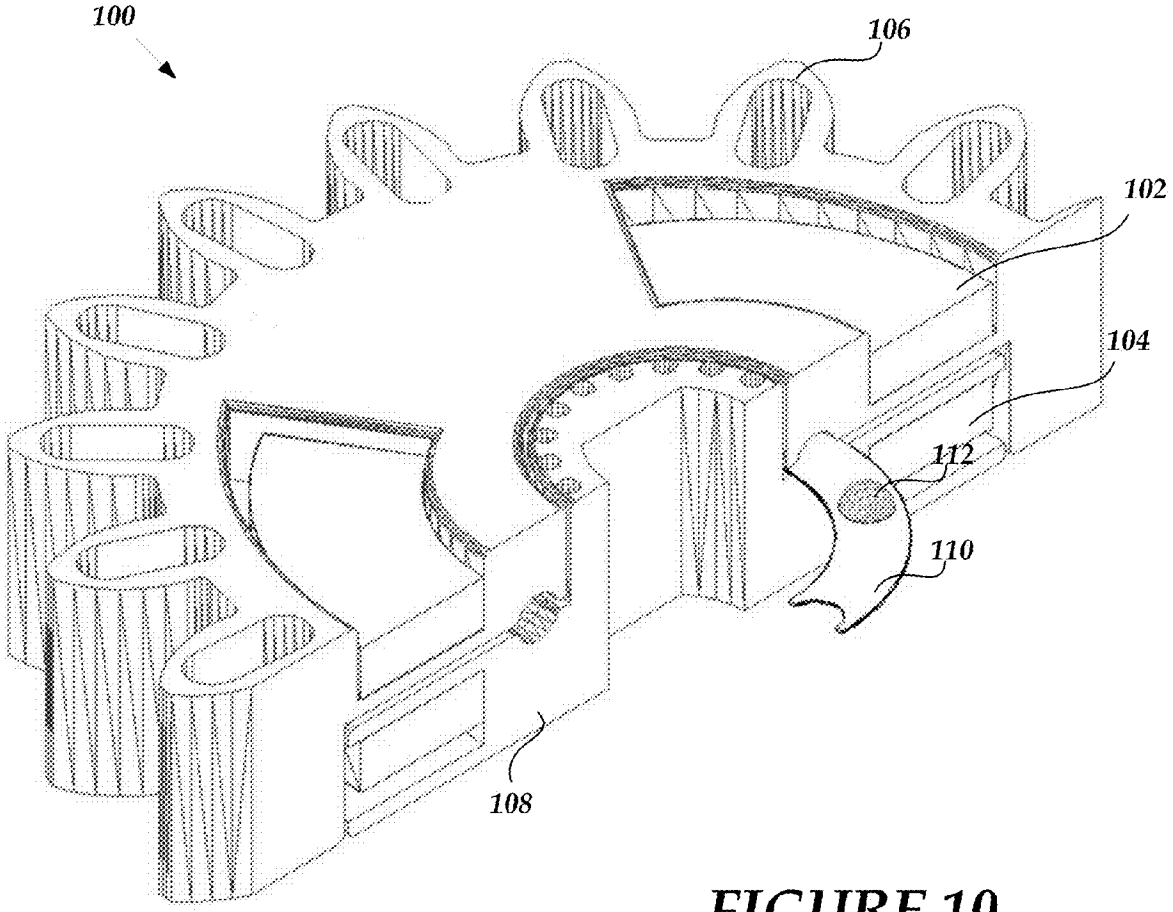
FIG. 10 is a side cross-sectional view of the cylindrical safety slip mechanism 100 of FIG. 9.

FIGS. 9-10 illustrate a further example cylindrical safety slip mechanism 100 which may be utilized in the system. In particular, FIG. 9 is an exploded view of a further example cylindrical safety slip mechanism 100, and FIG. 10 is a side cross-sectional view of the cylindrical safety slip mechanism 100 of FIG. 9. In some embodiments, the cylindrical safety slip mechanism 100 includes a first set of magnets 102, a second set of magnets 104, an upper housing 106, a lower housing 108, a bearing ring plate 110, and one or more ball bearings 112.

In this example, the first set of magnets 102 and the second set of magnets 104 have opposite polarities (i.e., positive and negative). As discussed below, the opposing magnet sets 102 and 104 attract each other inside of the upper and lower housings 106 and 108, and thus operate the safety slip mechanism 100 as a magnetic decoupler, which decouples opening or closing of the balusters of a deck railing (such as when a person inadvertently slips their extremities between the balusters) such that the movement of the balusters would stop thereby avoiding the pinching of the person's extremities between the balusters.

The upper housing 106 is configured to receive, and mount, the first set of magnets 102 on a top surface 114 of the upper housing 106. In some embodiments, the upper housing 106 includes recesses 116 configured to receive the first set of magnets 102. The upper housing 106 has a bottom surface that is opposite to the top surface of the upper housing 106. The bottom surface is configured to engage the lower housing 108, as shown in FIG. 10. In some embodiments, the upper housing 106 includes a threaded portion 117 configured to engage a control mechanism, such as the control screw 16, of the deck system. In some embodiments, the upper housing 106 is made from non-magnetic materials.

The lower housing 108 is configured to receive, and mount, the second set of magnets 104 on a side surface 118 of the lower housing. In some embodiments, the lower housing 108 includes pockets 120 configured to receive the second set of magnets 104. In some embodiments, the lower housing 108 includes a driving portion 122 configured to engage a drive shaft of a motor so that the safety slip mechanism 110 is operated by the motor. In some embodiments, the lower housing 108 is made from non-magnetic materials.

The bearing ring plate 110 is engaged between the upper housing 106 and the lower housing 108 and operates to allow a smooth rotation of the upper housing 106 relative to the lower housing 108. In some embodiments, the bearing ring plate 110 includes ball support holes 124 configured to rotatably support the ball bearings 112.

The ball bearings 112 are sized to sit on the ball support holes 124 and rotatably engaged between the upper housing 106 and the lower housing 108. The ball bearings 112 operate to roll as the upper housing 106 rotates relative to the lower housing 108.

In some embodiments, the cylindrical safety slip mechanisms 50, 90 and 100 are used as the control screw 16 of FIGS. 5 and 6. In other embodiments, the safety slip mechanisms 50, 90 and 100 are utilized in a drive train assembly 140, as shown in FIG. 11.

Figure 11:
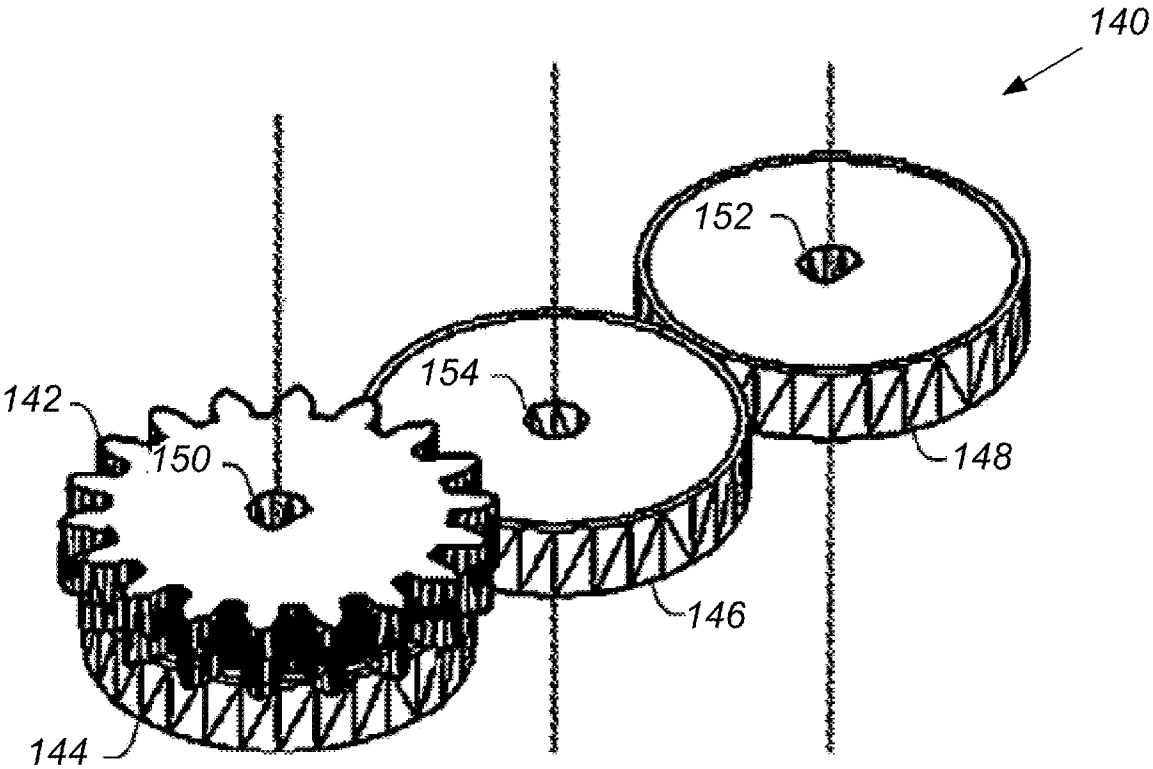
FIG. 11 illustrates an example drive train assembly utilizing the cylindrical safety slip mechanism of FIG. 7B, 7C, or 9.

FIG. 11 illustrates an example drive train assembly 140, utilizing the cylindrical safety slip mechanism 50, 90 or 100. In some embodiments, the cylindrical safety slip mechanism 50, 90 or 100 operates as a drive gear 142 located on the one end of the drive train system 140 and is coupled with a drive wheel 144. This drive wheel 144 is in contact with an idler wheel 146, which is in contact with a drive wheel 148. The drive train system 140 is made of as many drive and idler wheels as there are individually driven balusters. In some embodiments, the drive wheels 144 and 148 include respective oblong holes 150 and 152 to prevent slipping of the wheels on the drive shaft, whereas the idler wheel 146 includes a round hole 154 for free rotation on its shaft.

In some embodiments, the drive train assembly 140 does not include a drive gear 142, but only includes drive wheels 144, 146 and 148. The engaging surfaces of the drive wheels 144, 146 and 148 are made of rubber, which allows the drive wheels 144, 146 and 184 to engage one another by fractional force. These rubber drive wheels 144, 146 and 148 are advantageous in absorbing the shrink or expansion of the drive wheels due to variations in temperature, for example.

In other embodiments, various configurations of a drive train assembly are utilized as necessary. Examples of such configurations of a drive train assembly are disclosed in U.S. Pat. No. 7,673,853, titled Fencing Section with Adjustable Fencing Members, issued on Mar. 9, 2010, the disclosure of which is hereby incorporated by reference in its entirety. For example, the drive train assembly, which is also referred to herein as a drive mechanism, is coupled to the safety slip mechanism, and the safety slip mechanism can include a rack and one or more pinion gears. One of the pinion gears may be coupled to the drive mechanism and another pinion gear may be coupled to the moving balusters.

As shown in FIGS. 1A and 2A, the opposing balusters 20 and 28 of the panel sections 5 and 6 are arranged to form a first side 42 and a second side 44. In some embodiments, the first side 42 faces the interior of the deck, and the second side 44 faces the exterior of the deck. By selective operation of the opposing balusters 20 and 28 as described above, the interior of the deck can, or cannot, be seen from the second side 44

(the outside) through the gaps or spaces between the balusters 20 and 28, or the outside of the deck can, or cannot, be seen from the first side 42 (the inside) of the deck through the gaps or spaces formed between the balusters 20 and 28.

Furthermore, as described above, the opposing balusters are separate from other components, such as frame or barrier sections, and operatively connected to the other components. The opposing balusters are not integrated parts of the frame or barrier sections.

Referring back to FIG. 8, the lateral reinforced inserts are configured to reinforce balusters with relatively longer height or length. For example, the lateral reinforced inserts are inserted into the hollowed-out sections or voids of the balusters that have a length or height of more than about two feet, which is required by some building safety codes or regulations.

It will be apparent to those skilled in the art that various modifications or variations may be made without departing from the scope or spirit of the embodiments described herein. Other embodiments will be apparent to those skilled in the art from consideration of the specification and practice of the embodiments described herein.

What is claimed is:

1. A slide-glide panel privacy system for deck railings and fences comprising:

a first stationary panel section comprising a first plurality of balusters, the first plurality of balusters spaced apart from one another in a first direction to form first gaps between adjacent balusters of the first plurality of balusters;

a sliding panel section comprising a second plurality of balusters, the second plurality of balusters spaced apart from one another in a second direction to form second gaps between adjacent balusters of the second plurality of balusters, the second direction being parallel with the first direction;

an upper railing system attached to the first stationary panel section and the sliding panel section, the upper railing system including an upper slide track assembly configured to enable the sliding panel section to slide thereal-ong;

a lower railing system attached to the first stationary panel section and the sliding panel section, the lower railing system including a lower slide track assembly configured to enable the sliding panel section to slide thereal-ong;

at least one post attached to the upper railing system and the lower railing system and extending therebetween; and a plurality of slide pieces attached to the second plurality of balusters, the plurality of slide pieces facilitating the movement of the sliding panel section between open and closed orientations along a sliding path in the second direction, wherein, in the open orientation, the sliding panel section opens the first gaps between the adjacent balusters of the first plurality of balusters, and, in the closed orientation, the sliding panel section covers the first gaps between the adjacent balusters of the first plurality of balusters to provide a privacy barrier and block weather elements to separate an interior of a deck from an exterior of the deck, wherein the upper slide track assembly includes a first channel element and a second channel element, the first channel element of the upper slide track assembly attached to the first stationary panel section, and the second channel element of the upper slide track assembly attached to the sliding panel section and slidably received in the first channel element of the upper slide track assembly to limit movement of the sliding panel section along the sliding path in the second direction; and wherein the lower slide track assembly includes a first channel element and a second channel element, the first channel element of the lower slide track assembly attached to the first stationary panel section, and the second channel element of the lower slide track assembly attached to the sliding panel section and slidably received in the first channel element of the lower slide track assembly to limit the movement of the sliding panel section along the sliding path in the second direction.

2. The system of claim 1, wherein each of the first gaps is dimensioned to be substantially the same as a width of each baluster of the second plurality of balusters, and wherein each of the second gaps is dimensioned to be substantially the same as a width of each baluster of the first plurality of balusters.

3. The system of claim 1, wherein the sliding path of the sliding panel section is linear.

4. The system of claim 1, wherein the sliding path of the sliding panel section is curvilinear.

5. The system of claim 1, wherein the sliding panel section are displaceable between a first position and a second position, wherein the sliding panel section opens the first gaps in the first position, and close the first gaps in the second position, wherein the sliding path of the sliding panel section is substantially in parallel with, and spaced apart from, a stationary path of the first stationary panel section, wherein the sliding panel section remains in the sliding path when the one or more sliding panel section is in the second position.

6. The system of claim 1, wherein the sliding panel section is displaceable between a first position and a second position, wherein the sliding panel section opens the first gaps in the first position, and close the first gaps in the second position, wherein the sliding path of the sliding panel section is substantially in parallel with, and spaced apart from, a stationary path of the first stationary panel section, wherein the second plurality of balusters of the sliding panel section moves into the first gaps between the first plurality of balusters of the stationary panel section so that the sliding panel section is arranged along the stationary path of the first stationary panel section when the one or more sliding panel section is in the second position.

7. The system of claim 1, wherein the sliding panel section is constructed from a material selected from a group of a composite material, wood, metal, glass, and transparent thermoplastic.

8. The system of claim 1, wherein the movement of the sliding panel section comprises at least one of a manual operation or an automatic operation.

9. A slide-glide panel privacy system for deck railings and fences comprising:

a first stationary panel section comprising a first plurality of balusters, the first plurality of balusters spaced apart from one another to form first gaps between adjacent balusters of the first plurality of balusters;

a sliding panel section comprising a second plurality of balusters; and a safety slip mechanism operable by a power source and configured to move the sliding panel section with respect to the first stationary panel section between a first position and a second position, wherein the sliding panel section opens the first gaps between the first plurality of balusters in the first position and close the first gaps between the first plurality of balusters in the second position, the safety slip mechanism including a magnetic decoupler configured to decouple the sliding panel section from the power source when an object is placed in at least one of the first gaps to interfere with the movement of the sliding panel section with respect to the first stationary panel section, wherein the safety slip mechanism comprises:

a housing including a first sub-housing and a second sub-housing;

an engaging portion arranged on the housing and configured to engage the one or more sliding panel section;

a first magnet inserted in the first sub-housing; and a second magnet inserted in the second sub-housing, wherein the first and second magnets have opposing polarities;

wherein the first sub-housing is operatively engaged with the second sub-housing such that the first and second sub-housings are attracted to each other by the opposing polarities of the first and second magnets.

10. The system of claim 9, further comprising a shaft operable to facilitate a movement of the first sub-housing including the first magnet relative to the second sub-housing including the second magnet, wherein the first sub-housing is configured as a first elongate bar, wherein the second sub-housing is configured as a second elongate bar, and wherein the second sub-housing is slideably engaged with the first sub-housing.

11. The system of claim 9, further comprising a drive mechanism coupled to the safety slip mechanism, wherein the safety slip mechanism further comprises a rack and one or more pinion gears, one of the pinion gears coupled to the drive mechanism, and another pinion gear coupled to the sliding panel section.

12. The system of claim 9, wherein the first sub-housing is configured as a first cylindrical shape, wherein the second sub-housing is configured as a second cylindrical shape, and wherein the second sub-housing is rotatably engaged with the first sub-housing.

13. The system of claim 12, wherein the first sub-housing includes a threaded portion formed on a circumference thereof, the threaded portion configured to engage the engaging portion.

14. The system of claim 12, further comprising a bearing ring plate engaged between the first sub-housing and the second sub-housing and including one or more ball support holes; and one or more ball bearings configured to sit on the ball support holes and rotatably engaged between the first sub-housing and the second sub-housing.

15. A slide-glide panel privacy system for deck railings and fences comprising:

a first stationary panel section comprising a first plurality of balusters, each of the first plurality of balusters having a plurality of first hollowed-out portions;

a sliding panel section comprising a second plurality of balusters, the second plurality of balusters operable relative to the first plurality of balusters;

a railing system attached to the first stationary panel section and the sliding panel section; and a plurality of first lateral reinforced inserts inserted into two or more of the first hollowed-out portions of each of the first plurality of balusters, at least one of the plurality of first lateral reinforced inserts being entirely contained within the two or more of the first hollowed-out portions and spaced apart from the railing system, wherein each of the first plurality of balusters includes opposing insert guide grooves longitudinally formed along the plurality of first hollowed-out portions, and wherein at least one of the plurality of first lateral reinforced inserts is shaped as a flat plate having opposite longitudinal edges configured to slide in the opposing insert guide grooves when the plurality of first lateral reinforced inserts are inserted into the first hollowed-out portions.

16. The system of claim 15, further comprising one or more second lateral reinforced inserts, wherein the sliding panel section having second hollowed-out portions, and wherein the one or more second lateral reinforced inserts are inserted into the second hollowed-out portions of the second plurality of balusters.

17. The system of claim 15, wherein the first plurality of balusters are spaced apart from one another to form first gaps between adjacent balusters of the first plurality of balusters, wherein the second plurality of balusters are spaced apart from one another to form second gaps between adjacent balusters of the second plurality of balusters, and wherein the second plurality of balusters are configured to move along the sliding path such that the second plurality of balusters cover or open the first gaps.

18. The system of claim 17, wherein the first and second plurality of balusters are made from a polyvinyl chloride material, and the one or more lateral reinforced inserts are made from a metallic material.

* * * * *